US009494378B2

(12) United States Patent
Gomez

(10) Patent No.: US 9,494,378 B2
(45) Date of Patent: Nov. 15, 2016

(54) AMBIDEXTROUSLY OPERATED BOLT CATCH ASSEMBLY

(75) Inventor: Jesus S. Gomez, Trappe, MD (US)

(73) Assignee: LWRC International LLC, Cambridge, MD (US)

( * ) Notice: Subject to any disclaimer, the term of this patent is extended or adjusted under 35 U.S.C. 154(b) by 594 days.

(21) Appl. No.: 12/923,841

(22) Filed: Oct. 8, 2010

(65) Prior Publication Data

US 2012/0167424 A1 Jul. 5, 2012

(51) Int. Cl.
*F41A 35/06* (2006.01)
*F41A 17/42* (2006.01)

(52) U.S. Cl.
CPC ..... *F41A 35/06* (2013.01); *F41A 17/42* (2013.01)

(58) Field of Classification Search
CPC ..... F41A 17/42; F41A 35/06
USPC ..... 42/2, 14, 16–17; 89/1.4
See application file for complete search history.

(56) References Cited

U.S. PATENT DOCUMENTS 4,429,479 A 2/1984 Johnson
4,615,134 A 10/1986 Beretta
5,412,895 A 5/1995 Krieger
5,499,569 A 3/1996 Schuetz
5,519,954 A 5/1996 Garrett
6,508,158 B2 1/2003 Murello
6,763,755 B2 7/2004 Johnson
6,851,346 B1 2/2005 Herring
6,959,509 B2 11/2005 Vais
7,219,462 B2 * 5/2007 Finn ..... F41A 17/38 42/49.01
7,240,600 B1 7/2007 Bordson
7,363,740 B2 4/2008 Kincel
7,661,219 B1 * 2/2010 Knight, Jr. ..... F41A 3/42 42/17
8,261,652 B2 * 9/2012 Findlay ..... F41A 17/36 42/70.02
8,359,966 B1 * 1/2013 Brotherton ..... F41A 3/68 42/70.02
8,572,875 B2 * 11/2013 Sisgold ..... F41A 9/66 42/1.02
2006/0123683 A1 6/2006 Garrett et al.
2009/0031605 A1 2/2009 Robinson
2010/0275485 A1 * 11/2010 Findlay ..... 42/16
2015/0323271 A1 * 11/2015 McGinty ..... F41A 35/06 42/17

* cited by examiner

*Primary Examiner* — Stephen M Johnson
*Assistant Examiner* — Benjamin Gomberg
(74) *Attorney, Agent, or Firm* — Porzio, Bromberg & Newman P.C.

(57) ABSTRACT

An ambidextrously operated bolt catch assembly for a firearm facilitates ease of use by either right handed or left handed shooters. The ambidextrous bolt catch assembly includes two levers, one on each side of the firearm, that interact with each other. Each lever has a primary contact surface and a secondary contact surface. By depressing the primary contact surface of either lever, both levers rotate to move the bolt catch assembly from a displaced position to a static position. Conversely, by depressing the secondary contact surface of either lever, both levers rotate to move the bolt catch assembly from a static position to a displaced position.

13 Claims, 9 Drawing Sheets

AMBIDEXTROUSLY OPERATED BOLT CATCH ASSEMBLY

BACKGROUND OF THE INVENTION

1. Field of the Invention

The present invention relates generally to firearms and more particularly to firearm receivers with ambidextrous controls.

2. Description of the Related Art

In modern warfare individual infantry men still play a significant role in military operations. An individual soldier's effectiveness depends, to a large extent, on the speed at which the individual solider can manipulate the controls of the issued firearm. As such, ergonomic and ambidextrously designed controls can be critical. Various situations arise which require an infantry man to operate the bolt catch of a firearm.

A soldier's ability to provide a high rate of accurate fire on target is critical on the modern battle field. Detachable box magazines are the most common ammunition feeding device used with modern firearm designs. Examples of this are found in the M16 series of firearms, German G3 and the Belgian FAL. Designs such as the M16 and FAL have a mechanism which interacts with the follower of the detachable magazine causing the bolt carrier group to be locked to the rear when the magazine is empty. Additionally, all of the aforementioned designs incorporate a mechanism by which the bolt carrier group might be manually locked to the rear.

In the prior art there are bolt release mechanisms for the M16 family of firearms which can be operated with either hand. These mechanisms use a standard left side control lever which is in operational contact with the bolt carrier group. However, no mechanism is provided on the right side of the receiver for the user to retain and release the bolt carrier group from the locked-back position. In consideration of this fact alone these mechanisms cannot be considered truly ambidextrous.

Locking the bolt carrier group in its rearward position allows the user to look into the ejection port of the firearm and inspect the chamber for a live round or to clear an operational malfunction. Once a loaded magazine is inserted into the receiver, or a malfunction is cleared, the user needs an efficient means for releasing the bolt carrier group from the locked-back position.

Unfortunately the various mechanisms used, for example in the M16 family of firearms, to secure the bolt carrier group in the open, or locked-back, position are primarily designed for right-handed shooters. While a left-handed shooter can operate the mechanism, the procedure is often slower and requires the use of a certain amount of the user's concentration to look at the firearm. While the time required may be less than a second, an enemy action may occur during a critical time, thereby dangerously distracting the shooter.

Another relevant situation occurs often in urban conflict. When soldiers find themselves in a situation that requires target engagement around corners or in tight confines, it often becomes necessary to operate the weapon with the "weak hand" or the hand with which the shooter typically does not perform fine motor functions. In this situation, a right-handed shooter is often required, for safety, to use the weapon with the left hand or vise-versa. It is therefore desired to provide a way to improve the speed and efficiency of reloading and resuming operation of the firearm and other functions attendant to the securing and release of the firearm's bolt carrier group which is efficient for both right and left-handed users. Further, this improved function needs to operate without detracting from any other aspects of the firearm's use.

The conventional charging handle of an M16 type firearm may be used with either the left or right hand. By retracting the bolt carrier group to the rear using the handle, the operating lever of the bolt catch assembly may be depressed, thus locking the bolt to the rear. Another use of the charging handle is to release the bolt carrier group from the locked-back position. By retracting the bolt carrier group to its rearmost position, the mechanism holding the bolt can be moved out of the bolt's path to release the charging handle and allow the bolt carrier group to move into the battery position. The disadvantage of this operation is that the user is required to move out of the firing position, thereby delaying his response to an enemy action. Releasing the bolt using the operating lever of the bolt catch assembly eliminates the need to use the charging handle for this purpose, but would be awkward during left-handed operation of the firearm.

Therefore, a need exists for a device to retain and release the bolt carrier group which can be adapted to the receiver of the firearm to facilitate the true ambidextrous operation of the bolt catch assembly. This device needs to have operating levers present on both the right and left sides of the receiver. In addition, the placement of the bolt catch assembly should be both familiar to the user and not obstruct the function of the base firearm design.

SUMMARY OF THE INVENTION

In view of the foregoing, one object of the present invention is to overcome the difficulties encountered by left-handed shooters when operating conventionally designed automatic weapons having a lever for operating a bolt catch assembly only on the right side of the weapon.

Another object of the present invention is to provide a bolt catch assembly having two bolt catch operating levers, with the standard or primary lever on the left side of the firearm and a second or secondary lever on the right side of the firearm.

A further object of the present invention is to provide a bolt catch assembly in accordance with the preceding objects in which force independently applied to either operating lever causes both operating levers to rotate toward the receiver.

Yet a further object of the present invention is to provide a bolt catch assembly in accordance with the preceding objects in which each lever has a primary contact surface and a secondary contact surface, force applied to either of the primary contact surfaces moving both levers which, in turn, moves a bolt engagement leg of the bolt catch assembly to an unlocked or static position in which the bolt carrier group can move into battery position.

Still another object of the present invention is to provide a bolt catch assembly in accordance with the preceding objects in which force applied to either of the secondary contact surfaces, after the bolt has been manually withdrawn rearwardly with respect to the receiver, moves both levers which, in turn, moves the bolt engagement leg of the bolt catch assembly to a locked or displaced position in which the bolt carrier group is held in the locked-back position.

A further object of the present invention is to provide a bolt catch assembly in accordance with the preceding objects in which the placement of the bolt catch operating levers is familiar to the user of the host firearm and does not impede standard operation of the firearm.

It is yet another object of the invention to provide a bolt catch assembly that is not complex in structure and which can be manufactured at reasonable cost but yet efficiently allows both right and left-handed shooters to operate the bolt catch assembly to both restrain and release the bolt carrier group without moving out of the firing position.

In accordance with these and other objects, the present invention is directed to a fast, efficient and ambidextrous bolt catch assembly that allows the user to both release and restrain the bolt carrier group of an autoloading firearm designed to receive detachable box magazines. The bolt catch assembly according to the present invention includes a primary bolt catch operating lever in the standard position found on the left side of the receiver, as in the M16 series of firearms, and a secondary bolt catch operating lever, in operational contact with the primary lever, placed on the right side of the receiver above the trigger group. The primary bolt catch operating lever includes a pivotally movable body having a bolt engagement leg and an engagement surface. The secondary bolt catch operating lever is connected via a rotating shaft to a lift arm with a coupling element complementary to the engagement surface. The coupling element is operationally coupled with the engagement surface on the body of the primary bolt catch operating lever so that movement of either operating lever serves to vertically displace the bolt engagement leg of the bolt catch assembly between the locked or displaced position, and the unlocked or static position.

Each bolt catch operating lever has a primary contact surface and a secondary contact surface. The location of the contact surfaces is such that they may be easily pushed towards the receiver of the host firearm. Pressing on either the secondary contact surface of the primary bolt catch operating lever or the secondary contact surface of the secondary bolt catch operating lever, when the bolt is in its rearmost position, causes the secondary contact surfaces of both levers to move, toward the receiver. This movement is translated into upward vertical displacement of the bolt engagement leg into the locked or displaced position. In the locked or displaced position, the bolt engagement leg is moved into the path of the bolt, preventing the bolt carrier group from moving forwardly into the battery position. Depressing either of the primary contact surfaces on the primary and secondary bolt operating levers moves the primary contact surfaces of both levers toward the receiver, which results in downward vertical displacement of the bolt engagement leg into the unlocked or static position. In the unlocked or static position, the engagement leg of the bolt catch assembly is taken out of the path of the bolt. With the bolt engagement leg no longer obstructing the path of the bolt, the bolt carrier group returns to its forward or battery position under spring compression.

In addition to using the operating levers, the charging handle provided on the host firearm may still be used to release the bolt carrier group. By fully retracting the bolt to the rear, resistance provided by the bolt to hold the engagement leg in the locked position is removed, thus allowing the operating levers of the bolt catch assembly to move back into the static position.

These together with other functions and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

In order that the manner in which the above recited and other novel features and advantages of the invention are obtained will be readily understood, a preferred embodiment of the invention briefly described above will be rendered by reference to a specific embodiment thereof which is illustrated in the accompanying drawings. It is expressly understood that these drawings depict only a preferred embodiment of the invention and are not therefore to be considered to be limiting of its scope, the invention will be described and explained with additional specificity and detail through the use of the accompanying drawings.

DETAILED DESCRIPTION OF THE PREFERRED EMBODIMENTS

Figure 1:
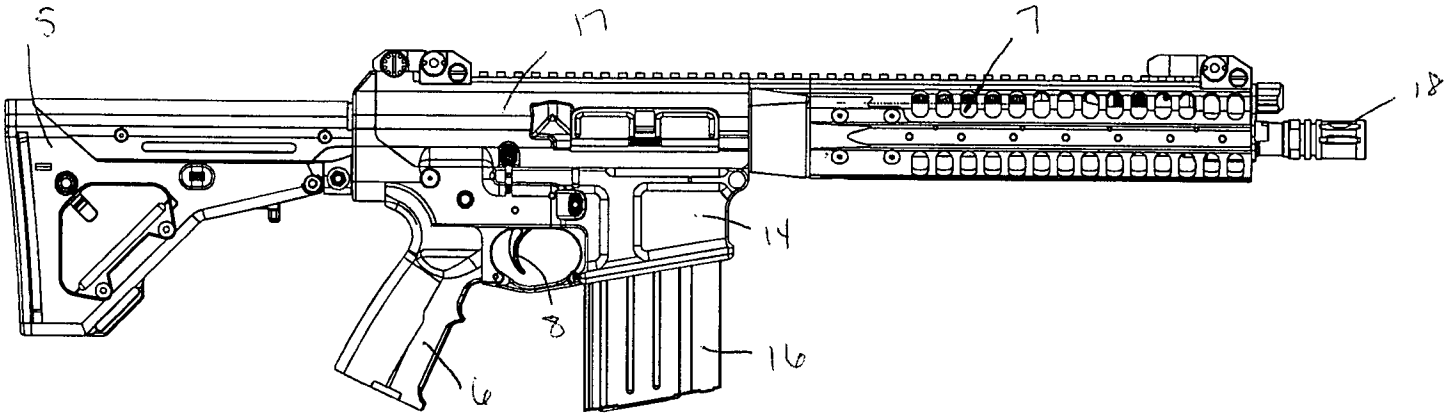
FIG. 1 is a right side view of an exemplary firearm for use with the ambidextrously operated bolt catch assembly in accordance with the present invention.

Although only one preferred embodiment of the invention is explained in detail, it is to be understood that the embodiment is given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

The present invention utilizes a number of physical principles to enhance the motion of parts in a firearm. The manner in which the present invention utilizes these principles to provide a modular ambidextrously operated firearm will be shown and described in greater detail with reference to FIGS. 1 through 7.

For this application, the phrases "connected to," "coupled to," and "in communication with", if and when used, refer to any form of interaction between two or more elements, including mechanical. The phrase "attached to", if and when used, refers to a form of mechanical coupling that restricts relative translation or rotation between the attached objects. The phrases "pivotally attached to" and "slidably attached to", if and when used, refer to forms of mechanical coupling that permit relative rotation or relative translation, respectively, while restricting other relative motion.

The phrase "attached directly to", if and when used, refers to a form of attachment by which the attached items are either in direct contact, or are only separated by a single fastener, adhesive, or other attachment mechanism. The term "abutting", if and when used, refers to items that are in direct physical contact with each other, although the items may not be attached together. The phrase "in operational contact", if and when used, means that the items come into contact during the normal operation of the device.

In addition, uses of the terms "bolt" and "bolt carrier group" are used interchangeably in many instances and are not intended to be exclusive in their reference to the bolt alone or to the bolt in combination with the bolt carrier and associated components unless so stated.

FIG. 1 depicts a right side view of a firearm, generally designated by reference numeral 1, in accordance with the present invention. The firearm 1, as shown, includes a buttstock 5, a grip 6, a lower receiver 14, an upper receiver 17, a bolt 13 and bolt carrier 15 (see FIG. 2) as part of a bolt carrier group generally designated by reference numeral 8, and a barrel 7.

In operation, the shooter holds the grip 6 in one hand while pressing the buttstock 5 against his/her shoulder. The buttstock 5 and the grip 6 are mounted to the lower receiver 14. Generally, the lower receiver 14 and the upper receiver 17 are configured to receive the bolt carrier group 8 with the bolt 13 and bolt carrier 15 as an assembly, and the barrel 7.

During normal operation, the bolt strips a cartridge from the magazine 16 and moves the cartridge forward into the barrel 7 as the bolt carrier group 8 moves towards a battery position. When the bolt carrier group 8 is in the battery position, the user can activate a trigger 8, which is mounted to the lower receiver 14. The trigger releases a cocked hammer (not shown) and the hammer strikes a firing pin (not shown). The firing pin moves forward and ignites the loaded cartridge. As a result, the bullet contained in the cartridge is released to travel down the barrel 7 and exit at the muzzle 18. In automatic and semi-automatic firearms, the resulting explosion causes the bolt carrier group 8 to be moved in a backward direction opposite the direction of bullet travel. This backward movement of the bolt carrier ejects the spent cartridge. An action spring 75 (see FIGS. 6*a*-6*c*) opposes the rearward travel of the bolt carrier 15 and, after sufficient compression, when the bolt carrier 15 is not in the locked-back position, the compressed action spring 75 moves the bolt carrier group 8 forwardly so that another cartridge can be stripped from the magazine 16 and the bolt carrier group can be returned to the battery position.

Figure 2:
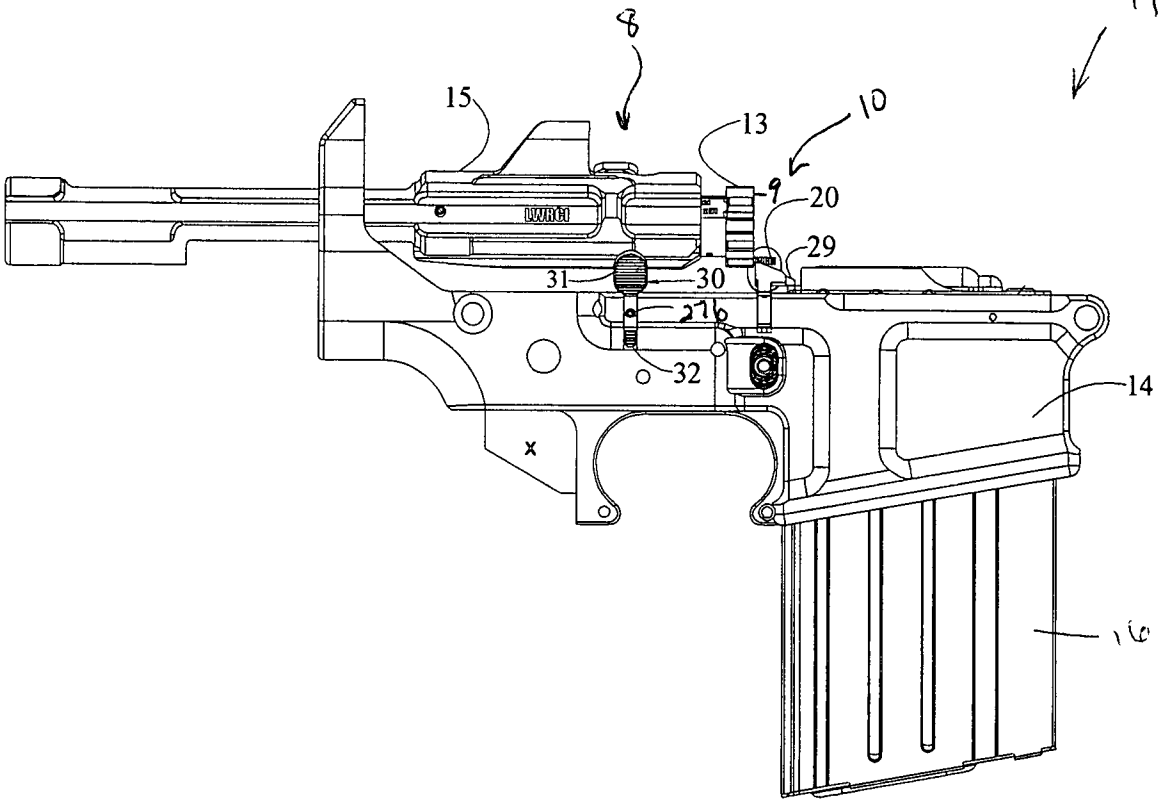
FIG. 2 is a right side view of the ambidextrously operated bolt catch assembly and lower receiver of the firearm shown in FIG. 1.
Figure 3:
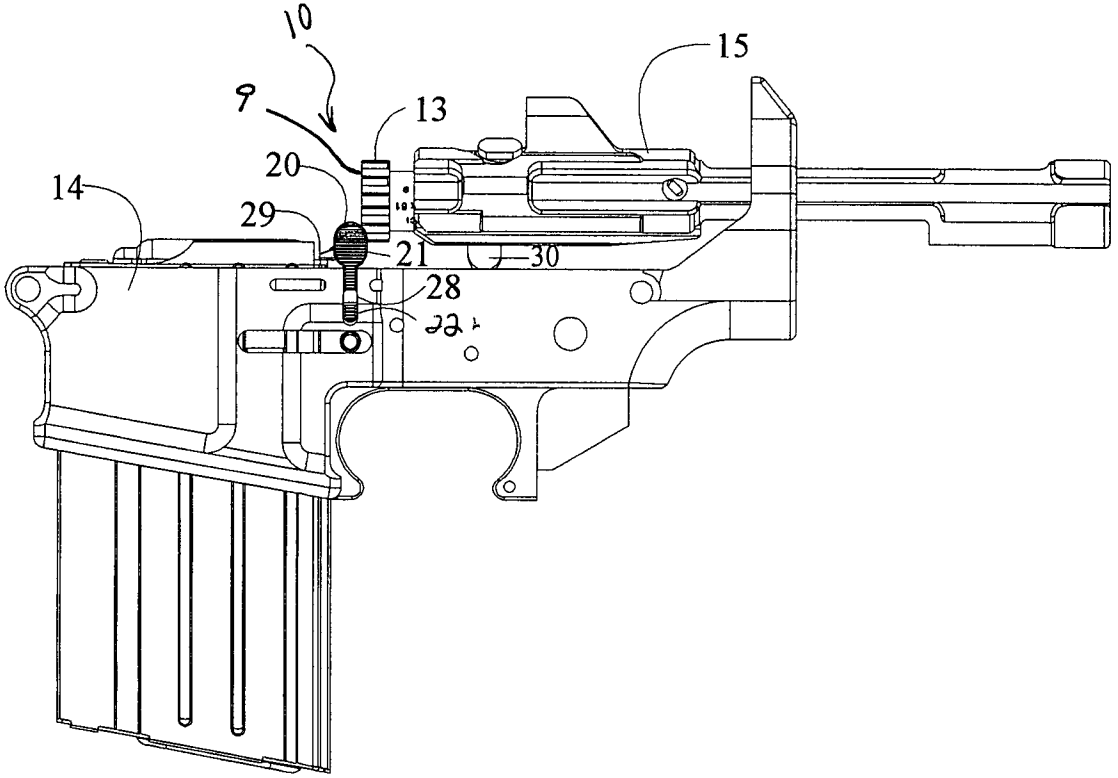
FIG. 3 is a left side view of the bolt catch assembly and lower receiver of FIG. 2.

FIGS. 2 and 3 illustrate right and left side views, respectively, of a lower receiver assembly generally designated by reference numeral 19 with a lower receiver 14 from an M16 type firearm. The lower receiver assembly 19 includes a bolt catch assembly generally designated by reference numeral 10, shown in exploded view in FIG. 4, and cut-away view in FIG. 5. The bolt catch assembly 10 includes a body 25 having an integrally formed primary bolt catch operating lever 20, a spring 38, a detent 39, a secondary bolt catch operating lever 30, a lift arm 34 having a coupling element 35, and a rotating shaft 33. While the secondary bolt catch operating lever 30, lift arm 34 with coupling element 35, and rotating shaft 33 are shown as separate components, any or all of these components could be formed as a unitary assembly or as partial sub-assemblies, as would be understood by persons of ordinary skill in the art. For example, the lift arm 34 and the operating lever 30 could be formed as a unitary piece, with rotating shaft 33 configured as a fixed axle pin similar to pin 27*a*. The present invention is intended to cover all variations in construction of the individual components that achieve the same functionality disclosed herein.

The body 25 is pivotally mounted to the receiver 14 by a pin 27*a* that extends through an opening 26 in the primary bolt catch operating lever 20 and through a pair of gudgeons 28 (see FIG. 3) on the side of the receiver 14. In addition to the integrally-formed primary bolt catch operating lever 20, the body 25 also includes a bolt engagement leg 24, a bolt stop pin 29, and an engagement surface 23 that are integral with the body. It would, of course, be possible to construct the body in a plurality of separate parts rather than with the indicated integral components as disclosed herein. Also, while the bolt engagement component 24 is described herein as a "leg", other elements or structures of various configurations could also be used to perform the disclosed bolt-blocking function when in a locked or displaced position as would be understood by persons skilled in the art.

As a result of the pivotal mounting of the body 25 on pin 27*a*, the bolt engagement leg 24 is vertically translatable between a static or unlocked position and a displaced or locked position relative to the bolt 13, as will be described more fully hereinafter. Concurrently, the bolt stop pin 29 also moves vertically with the pivoting of the body 25 to engage the cartridge follower 45 (see FIG. 7) on the magazine 16 when the magazine is empty, as will also be described more fully hereinafter.

When the bolt catch assembly 10 is assembled, the engagement surface 23 on the body 25 is in abutting operational contact with the coupling element 35 on the lift arm 34 so as to be pivotally coupled thereto. The lift arm 34 is coupled to the rotating shaft 33 by a roll pin 41. The secondary bolt catch operating lever 30 is secured by a pin 27*b* to the rotating shaft 33 which is received by a through hole 43 in the lower receiver 14. The rotating shaft 33 has various openings along its length to facilitate the coupling of the shaft 33 to the other connected components.

As shown, the body 25 and primary bolt catch operating lever 20 are mounted on the left side of the lower receiver 14. The secondary bolt catch operating lever 30 and the lift arm 34 are mounted on the right side of the lower receiver 14. Thus, in a preferred embodiment of the present invention, the bolt catch assembly 10 may be operated from either side of the receiver 14 and thus on both sides of the firearm, by using either the primary bolt catch operating lever 20 on the left side or the secondary bolt catch operating lever 30 on the right side. Hence, the inclusion of the two bolt catch operating levers 20, 30 provides a receiver 14 suited for ambidextrous use and having enhanced ergonomics.

The primary bolt catch operating lever 20 includes a primary contact surface 21 and a secondary contact surface 22. Similarly, the secondary bolt catch operating lever 30 includes a primary contact surface 31 and a secondary contact surface 32. When the bolt catch assembly 10 is assembled, pressure is applied against the back side of the secondary contact surface 22 on the primary bolt catch operating lever 20 by the spring 38 and detent 39. This pressure biases the bolt engagement leg 24 of the body 25 to the static or unlocked position, i.e., to the position in which the bolt engagement leg 24 does not interfere with forward movement of the bolt 13 to the battery position.

More particularly, the bolt stop pin 29, bolt engagement leg 24, engagement surface 23, and primary bolt catch operating lever 20 of the body 25 are all formed as an integral unit that is pivotally movable on an axis, defined by pin 27*a*, that is generally parallel with the longitudinal axis of the receiver. Therefore, in response to inward pressure applied to the primary contact surface of the primary bolt catch operating lever 20, the primary contact surface 21 moves toward the receiver and the bolt engagement leg 24, bolt stop pin 29, and engagement surface 23 are rotated downwardly. This downward vertical displacement of the bolt engagement leg 24 relative to the face 9 of the bolt 13 places the bolt engagement leg 24 in the static or unlocked position in which the bolt engagement leg is not in the path of the bolt's forward movement.

As already noted, the engagement surface 23 on the body also rotates downwardly concurrently with the downward rotation of the bolt engagement leg 24. This movement of the engagement surface 23 is transferred to the coupling element 35 on the lift arm 34 due to the operational relationship between the engagement surface and the coupling element. As a result, the coupling element 35 is displaced downwardly as the lift arm rotates, counterclockwise with respect to the view shown in FIG. 4, with the shaft 33. Rotation of the shaft 33 in turn causes the primary contact surface 31 on the secondary bolt catch operating lever 30, which is coupled to the shaft 33 by pin 27*b*, to rotate toward the receiver. Therefore, it is evident that pressing on either the primary contact surface 21 of the primary bolt catch operating lever 20 or the primary contact surface 31 of the secondary bolt catch operating lever 30, causes the primary contact surfaces 21, 31 of both levers 20, 30 to move toward the receiver 14.

Figure 4:
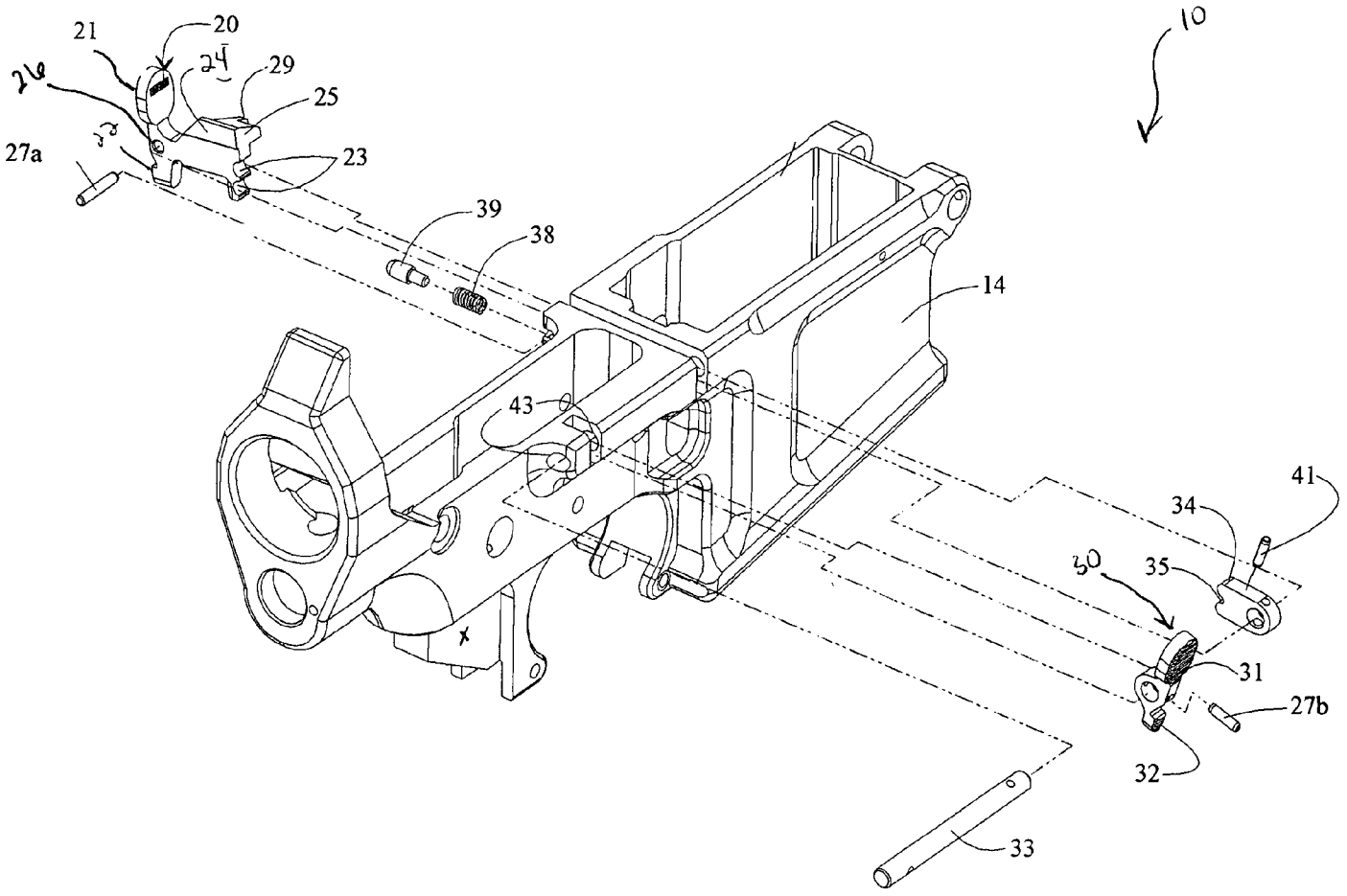
FIG. 4 is an exploded perspective view of the components of the bolt catch assembly and lower receiver shown in FIGS. 2 and 3.
Figure 5:
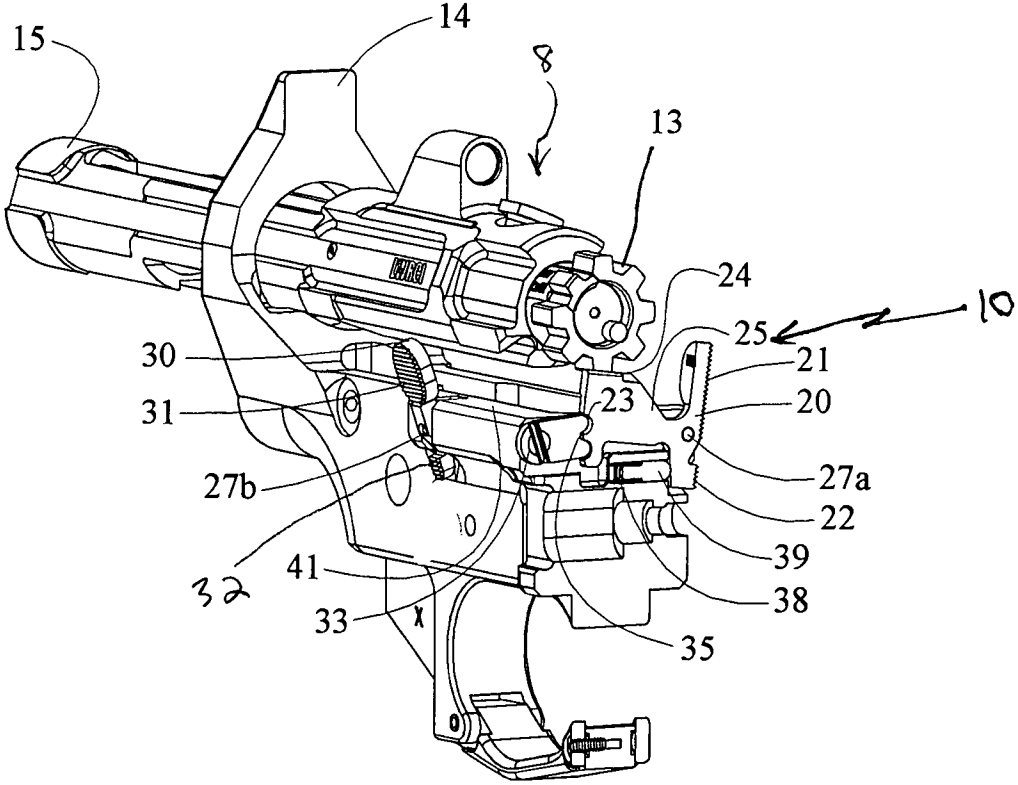
FIG. 5 is a front cut-away perspective view of the lower receiver and bolt catch assembly of FIG. 4, with the bolt and bolt carrier in place.

While the engagement surface 23 on the body is shown in FIG. 4 as a toothed structure that fits into a corresponding groove in the coupling element 35 on the lift arm 34, these cooperating structures are representative only, as other configurations could also be used to transfer pivotal movement between operationally coupled components as would be understood by persons of ordinary skill in the art.

With the bolt engagement leg 24 in the static or unlocked position, the spring 38 and detent 39 bias the bolt catch assembly 10 to remain in the static or unlocked position. The displaced or locked position of the bolt engagement leg 24 is only desired when the bolt carrier group is to be locked-back, such as for reloading or clearing of the chamber.

As is known in the art, when the last cartridge that was contained in the magazine 16 has been discharged from a semi-automatic weapon, the cartridge follower 45 (see FIG. 7) on the magazine is engaged and the bolt is locked back in a rearward position, exposing the empty chamber. With the bolt in this rearward or locked-back position, the empty magazine 16 is removed and replaced by another loaded magazine. To place the weapon into a condition where it may be fired, the bolt must be released to move forwardly so the bolt can carry a round from the loaded magazine into the chamber of the firearm.

Figure 6A:
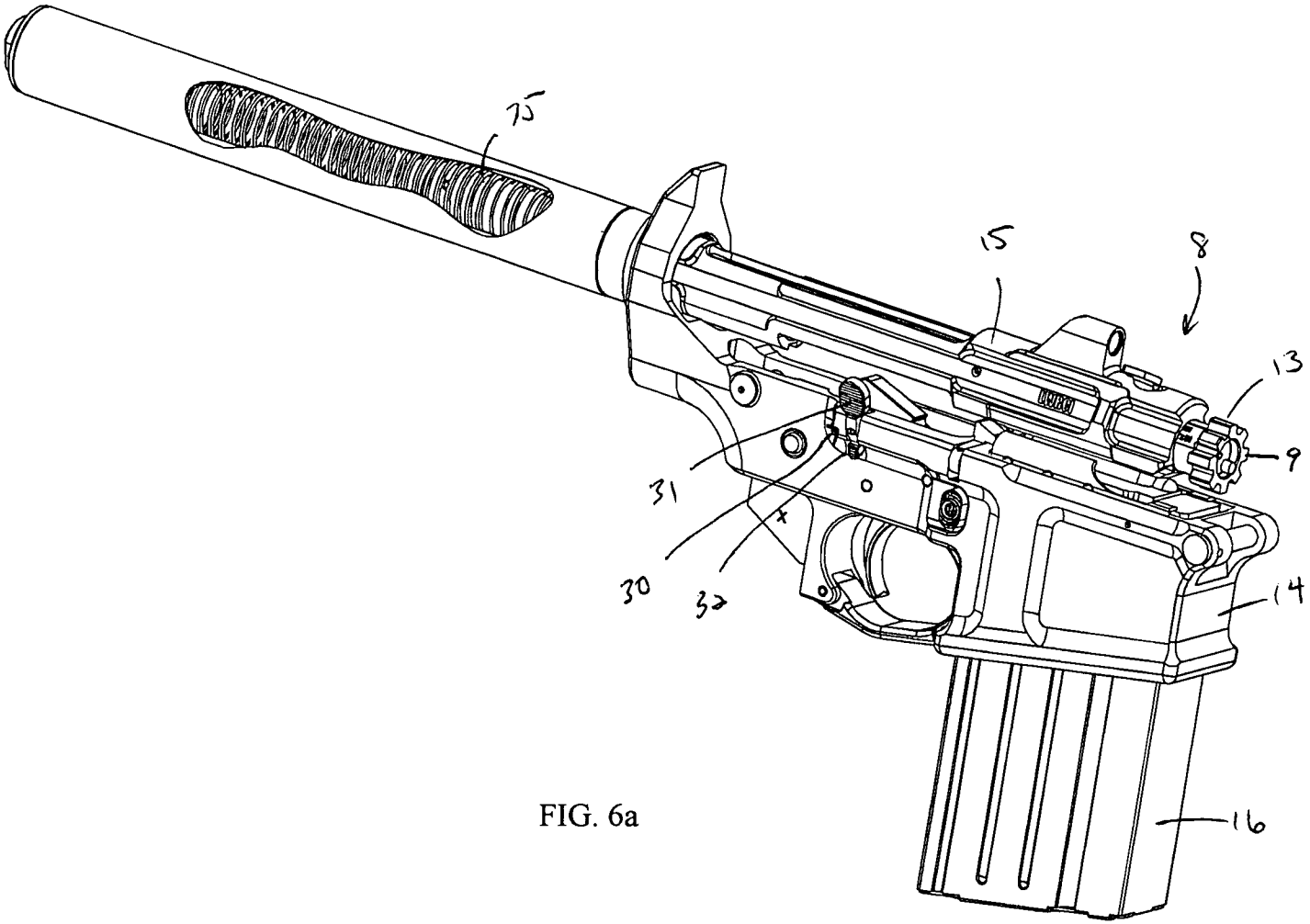
FIG. 6*a* is a partial perspective right side view of the receiver after the last cartridge has been removed from the magazine through firing and while the bolt carrier group is still in the battery position.
Figure 6B:
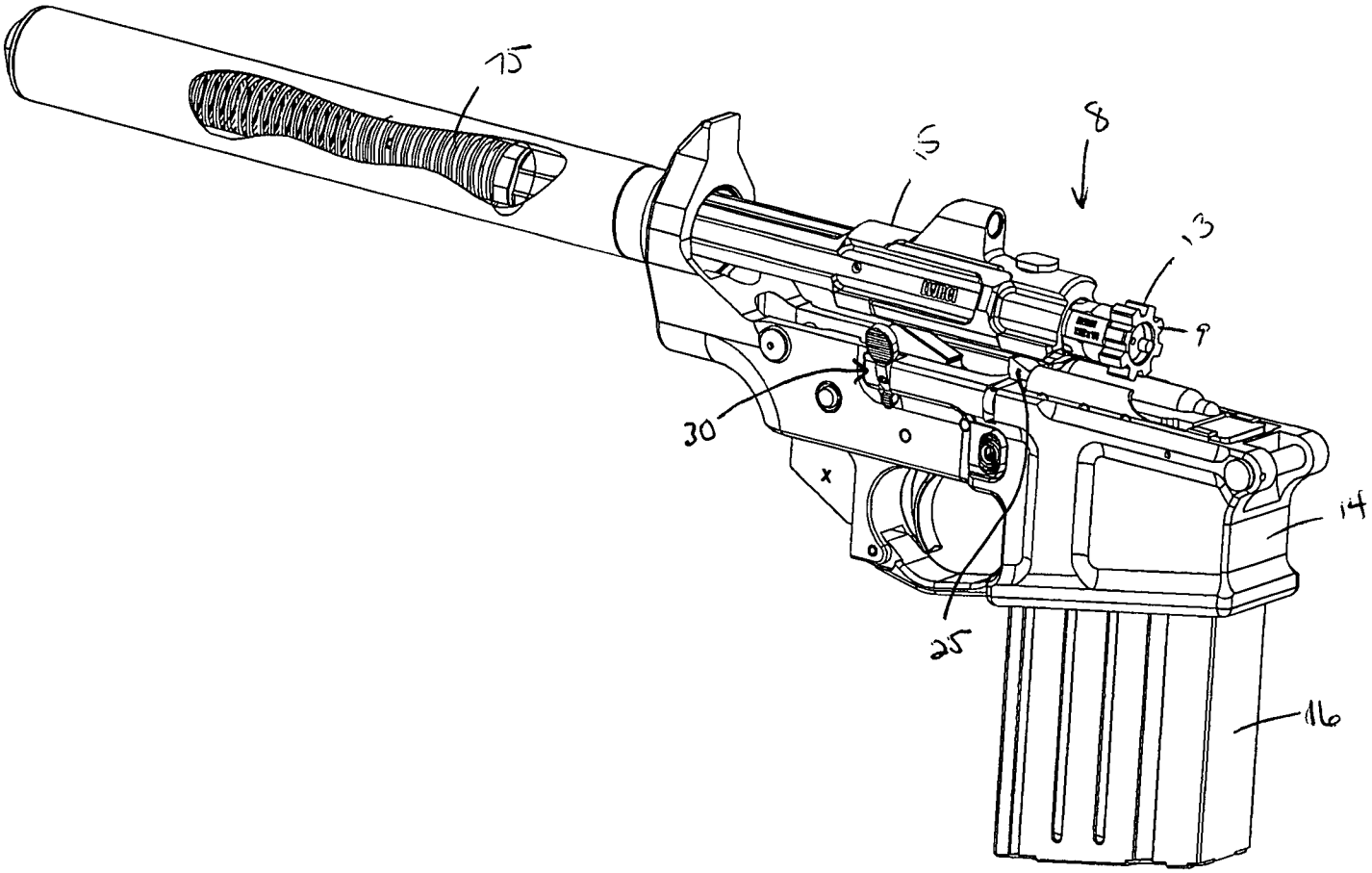
FIG. 6*b* is a partial perspective right side view taken in sequence after the view shown in FIG. 6*a*, with the bolt carrier group moving toward the recoiled position.
Figure 6C:
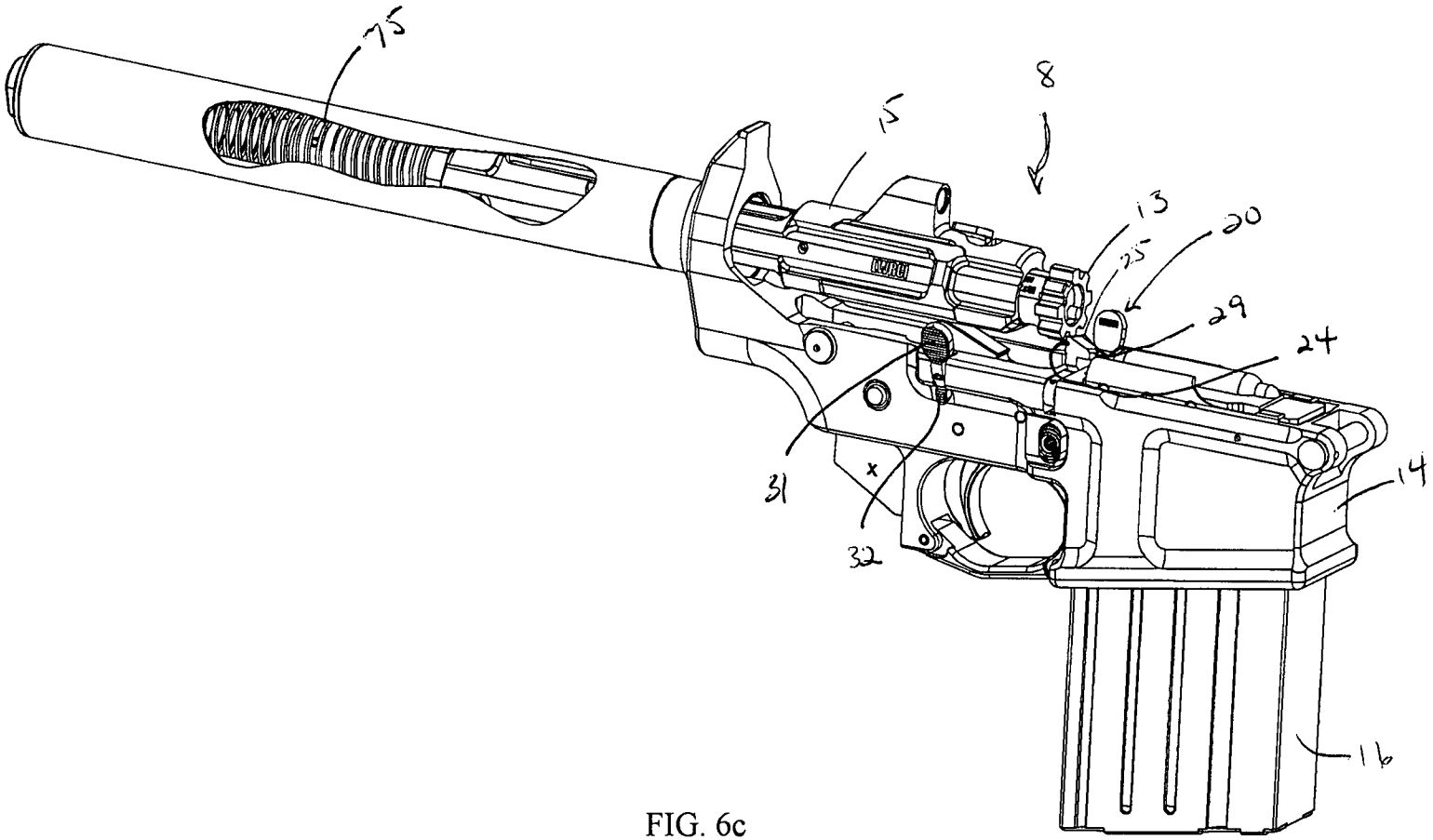
FIG. 6*c* is a partial perspective right side view taken in sequence after the view shown in FIG. 6*b* with the bolt carrier group in the locked-back position and the bolt held against the bolt engagement leg of the bolt catch assembly.

FIGS. 6*a*-6*c* depict the sequence by which the bolt carrier group moves rearwardly and is locked in the locked-back position after emptying the magazine in the course of firing and incorporating the bolt catch assembly according to the present invention. FIG. 6*a* illustrates a partial perspective view of a preferred embodiment of a receiver 14 after the last cartridge has been removed from the magazine 16 with a bolt 13 in the battery position. Once the magazine is empty, the cartridge follower presses upwardly against the bolt stop pin 29. As previously described and shown in FIGS. 4 and 5, the bolt stop pin 29 is integral to the body 25. Therefore, by pushing upwardly on the bolt stop pin 29, the cartridge follower 45 exerts an upward force on the body 25 and the bolt engagement leg 24. Upward movement of the bolt engagement leg 24 is inhibited in the battery position, however, by the presence of the bolt 13 and bolt carrier 15. Thus, when the bolt carrier 15 is in the battery position, as shown in FIG. 6*a*, the bolt carrier 15 prevents upward movement of the bolt engagement leg 24 into the path of the bolt. Once the last cartridge is fired, however, the bolt carrier and bolt move from the battery position toward the recoiled position.

FIG. 6*b* illustrates a subsequent sequential view following that shown in FIG. 6*a*, with the bolt 13 and bolt carrier 15 moving towards the recoiled position. As is readily apparent, once the bolt carrier 15 moves far enough rearwardly during recoil, the bolt engagement leg 24 is released from the inhibiting presence of the bolt carrier 15. The force exerted on the bolt stop pin 29 by the cartridge follower will direct upward movement of the bolt engagement leg 24 as the body 25 rotates on pin 27*a*. The integrally formed primary bolt catch operating lever 20 and the operationally coupled secondary bolt catch operating lever 30 also rotate so that their primary contact surfaces 21, 31 move away from the receiver. As a result, the bolt engagement leg 24 moves upwardly from the static or unlocked position to the displaced or locking position relative to the face 9 of the bolt 13.

As previously discussed, the action spring 75 biasing the bolt carrier 15 towards the battery position compresses as the bolt carrier 15 moves towards the fully recoiled position. Once the bolt carrier 15 reaches the fully recoiled position, the compressed operating spring applies force to direct the bolt carrier 15 back towards the battery position if the bolt engagement leg 24 is in the static or unlocked position, i.e., if the magazine is not yet empty.

Figure 7:
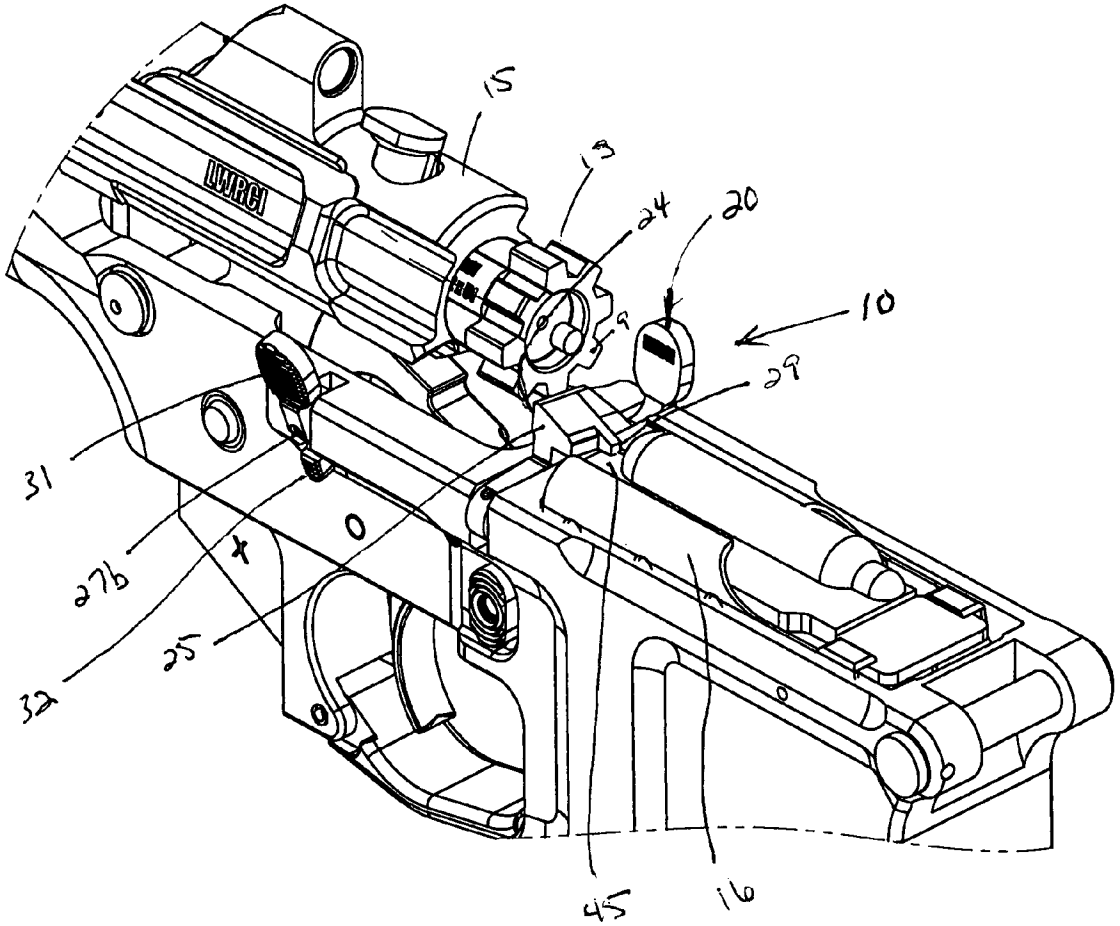
FIG. 7 is an enlarged view of a central portion of FIG. 6*c*, showing the engagement between the bolt engagement leg and the bolt when the bolt is held in the locked-back position by the bolt catch assembly according to the present invention.

FIG. 6*c* is a subsequent sequential view following that shown in FIG. 6*b*. FIG. 7 is an enlarged view, from a slightly different angle, of the portion of FIG. 6*c* that shows the face 9 of the bolt 13 in contact with the bolt engagement leg 24. As is evident, returning forward movement of the bolt carrier 15 and bolt 13 is interrupted by contact of the bolt face 9 with the bolt engagement leg 24 so that the bolt 13 and bolt carrier 15 are blocked by the engagement leg and held in the locked-back position. The cartridge follower still exerts an upward force upon the bolt stop pin 29 and the compressed operating spring 75 still exerts a forward force on the bolt carrier 15 when the bolt is in the locked-back position.

As just described, in the blocking position, the bolt engagement leg 24 prevents forward movement of the bolt 13, holding it in the locked-back position (see FIGS. 6*c* and 7). Similarly, because of the operational contact between the bolt stop pin 29, the engagement leg 24 and both bolt catch operating levers 20, 30, the bolt may be manually placed in the locked-back position by applying pressure to either of the secondary contact surfaces 22, 32 of the bolt operating levers 20, 30, respectively, after the bolt has been manually withdrawn rearwardly with respect to the lower receiver 14. Particularly, with the bolt carrier group retracted back, inward pressure on either of the secondary contact surfaces 22, 32, rotates the body 25 to move the bolt engagement leg 24 upwardly to engage the face 9 of the bolt 13 and hold the bolt in its locked-back position. Conversely, when either of the primary contact surfaces 21, 31 of either bolt catch operating lever 20, 30 is pressed inwardly towards the receiver 14, the bolt engagement leg 24 is rotated downwardly and thereby disengaged to release the bolt 13 and allow the bolt carrier group to be moved forwardly to the battery position by the energy stored in the action spring 75.

According to the present invention, therefore, a firearm including a receiver and an ambidextrously operated bolt catch assembly 10 is provided. In such a firearm, after removing an empty magazine 16 and inserting a loaded magazine, the ambidextrously operated bolt catch assembly can be actuated by depressing either the primary or secondary bolt catch operating levers 20, 30, so as to allow the bolt carrier group to return to battery position, stripping a cartridge from the magazine 16 in the process. Thus, the firearm according to the present invention is suited for ambidextrous release and restraint of the bolt in a manner which would be familiar to users of the M16 family of firearms.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A firearm with an ambidextrously operated bolt catch assembly, comprising:

a receiver;

a bolt carrier group having a bolt; and a bolt catch assembly including, a bolt engagement leg configured for moving between a displaced position in which said bolt engagement leg engages the bolt of the firearm to hold the bolt in a locked-back position, and a static position in which said bolt engagement leg moves out of a path of said bolt to allow the bolt carrier group to go to a battery position;

a primary bolt catch operating lever located on one side of the receiver and operably connected to the bolt engagement leg;

a secondary bolt catch operating lever located on an opposing side of the receiver, said secondary bolt catch operating lever is connected to a lift arm by a rotating shaft which extends therebetween, wherein the rotating shaft is a separate component from the secondary bolt catch operating lever and wherein the rotating shaft is housed in a through hole in a wall of the receiver, wherein the through hole is generally parallel to a longitudinal axis of a barrel, thereby avoiding exposure of the rotating shaft to an inside of the receiver housing a trigger group, and wherein the combination of said rotating shaft and said lift arm place said secondary bolt catch into operational contact with the bolt engagement leg;

each of said operating levers has a primary contact surface and a secondary contact surface, said operating levers being configured so that when force is independently placed on the primary contact surface of either operating lever, the primary contact surfaces of both operating levers are rotated towards the receiver and the bolt engagement leg is moved into the static position, and wherein said secondary bolt catch operating lever is configured so that when force is independently placed on the primary contact surface of the secondary bolt catch operating lever the secondary bolt catch operating lever rotates around a longitudinal axis of the rotating shaft; and each of said operating levers are configured so that when force is independently placed on the secondary contact surface of either operating lever, the secondary contact surfaces of both operating levers are rotated towards the receiver and the bolt engagement leg is moved into the displaced position.

2. The firearm with an ambidextrously operated bolt catch assembly of claim 1, wherein the primary bolt catch operating lever and the bolt engagement leg are a single unitary element.

3. The firearm with an ambidextrously controlled bolt catch assembly of claim 2, wherein the bolt engagement leg has an engagement surface abutting said lift arm which is operationally coupled to the rotating shaft.

4. The firearm with an ambidextrously controlled bolt catch assembly of claim 2, wherein said single unitary element rotates on a pin having an axis that is generally parallel with a longitudinal axis of said bolt and of said rotating shaft.

5. The firearm with an ambidextrously controlled bolt catch assembly of claim 1, wherein the receiver includes a plurality of holes to define primary and secondary bolt catch operating lever attachment positions, said attachment positions being offset from one another.

6. An ambidextrously operated bolt catch system comprising:

a bolt moveable along a longitudinal axis of a bolt carrier configured for receiving the bolt, said bolt being moveable between a battery position and a locked-back position;

a magazine with a follower;

a bolt catch assembly including a bolt engagement portion and a follower engagement portion having a contact element, a primary operating lever in direct contact with the bolt engagement portion and a secondary operating lever secured about a rotating shaft having a lift arm secured at one end which effectively places said secondary operating lever into operational contact with the primary operating lever, wherein said rotating shaft is a separate component from the secondary operating lever and wherein the rotating shaft is housed in a through hole in a wall of a lower receiver, wherein the through hole is generally parallel to a longitudinal axis of a barrel, thereby avoiding exposure of the rotating shaft to an inside of the lower receiver housing a trigger group, and wherein said bolt engagement portion being movable transversely to the longitudinal axis of the bolt carrier between a static position in which said bolt engagement portion does not interfere with movement of the bolt to the battery position, and a displaced position in which the bolt engagement portion locks the bolt in the locked-back position;

at least one of said contact element of said follower engagement portion and said operating levers being configured to urge the bolt catch assembly toward the displaced position from the static position in response to the contact element of the follower engagement portion engaging the magazine follower, or the operating levers being moved by a user;

said primary operating lever being placed on one side of the firearm and said secondary operating lever being placed on an opposite side of the firearm, said primary and secondary operating levers being offset from one another;

said operating levers defining both a primary contact surface and a secondary contact surface, said operating levers being configured so that when force is independently placed on the primary contact surface of either operating lever, the primary contact surfaces of both operating levers are rotated towards the firearm and the bolt engagement portion is moved into the static position, and wherein said secondary operating lever is configured so that when force is independently placed on the primary contact surface of the secondary operating lever the secondary operating lever rotates around a longitudinal axis of the rotating shaft; and said operating levers are also configured so that when force is independently placed on the secondary contact surfaces of either operating lever, the secondary contact surfaces of both operating levers are rotated towards the firearm and the bolt engagement portion is moved into the displaced position.

7. The ambidextrously operated bolt catch system of claim 6, wherein said contact element is a bolt stop pin.

8. The ambidextrously operated bolt catch system of claim 6, wherein the primary operating lever and the bolt engagement portion are a single unitary element.

9. The ambidextrously operated bolt catch system of claim 8, wherein the bolt engagement portion has an engagement surface abutting the lift arm and is pivotally movable with respect to said lift arm.

10. The ambidextrously operated bolt catch system of claim 8, wherein said single unitary element rotates on a pin having an axis that is generally parallel with the longitudinal axis of said bolt and of said rotating shaft.

11. The ambidextrously operated bolt catch system of claim 8, wherein said bolt engagement portion moves upwardly to said displaced position and downwardly to said static position.

12. The ambidextrously operated bolt catch system of claim 6, wherein said bolt engagement portion is biased to the static position by a spring element.

13. The ambidextrously operated bolt catch system of claim 12, wherein said spring element is positioned between said lower receiver and a back surface of the secondary contact surface on the primary operating lever.

* * * * *